US006411040B1

(12) United States Patent
Ertl et al.

(10) Patent No.: US 6,411,040 B1
(45) Date of Patent: Jun. 25, 2002

(54) APPARATUS AND CIRCUIT FOR OPERATING A DISCHARGE LAMP OF A MOTOR VEHICLE AT TWO POWER LEVELS

(75) Inventors: Bernhard Ertl; Guenther Hirschmann, both of Munich; Thomas Reiners, Stetten, all of (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/040,772

(22) Filed: Mar. 18, 1998

(30) Foreign Application Priority Data

Mar. 18, 1997 (DE) ..... 197 11 183

(51) Int. Cl.[7] ..... H05B 37/02

(52) U.S. Cl. ..... 315/82; 315/224; 315/307; 307/10.8

(58) Field of Search ..... 315/82, 224, 307; 307/10.8

(56) References Cited

U.S. PATENT DOCUMENTS 4,322,715 A * 3/1982 Moon ..... 340/81 R
5,491,387 A * 2/1996 Saito ..... 315/307
5,523,655 A * 6/1996 Jennato et al. ..... 315/246

FOREIGN PATENT DOCUMENTS

EP 0700074 A2 3/1996

* cited by examiner

*Primary Examiner*—David Vu
(74) *Attorney, Agent, or Firm*—Carlo S. Bessone

(57) ABSTRACT

An apparatus for operating a discharge lamp from an on-board voltage source of a motor vehicle. The discharge lamp is operated at a first electrical power to produce a taillight and is operated with a second, higher power to produce a signal light.

21 Claims, 2 Drawing Sheets

APPARATUS AND CIRCUIT FOR OPERATING A DISCHARGE LAMP OF A MOTOR VEHICLE AT TWO POWER LEVELS

TECHNICAL FIELD

The field of application of the invention lies in the region of motor vehicle lighting. For some time, there have been efforts to replace the incandescent lamps previously common for producing taillights, brake lights, and blinking lights, by discharge lamps, particularly by neon gas discharge lamps or fluorescent lamps. These named discharge lamps offer the advantage of a considerably shorter response time when compared with incandescent lamps, so that, for example, with the use of a neon gas discharge lamp for producing the brake light, the brake light is illuminated essentially earlier when the brake pedal in the motor vehicle is activated than would be the case with the use of an incandescent lamp as the brake light. The difference in response time amounts to approximately 0.2 s for discharge lamps, which corresponds to a braking path of approximately 6 m with a vehicle speed of 100 km/h. In addition, discharge lamps are also characterized by a high light yield and a long service life when compared to incandescent lamps. In addition, the discharge vessel of discharge lamps can be adapted without problem to the desired lighting design and the shape of the rear end of the motor vehicle body. In order to operate discharge lamps, of course, ballast devices are required, which generate voltages required for ignition and for operating discharge lamps from the on-board supply voltage of the motor vehicle.

STATE OF THE ART

A process corresponding to the preamble of Patent Claim 1 for operating a discharge lamp is disclosed, for example, in European Patent Application EP 0 700,074. This publication describes an operating method for a neon gas discharge lamp, which has a discharge vessel provided with a fluorescent coating, and which fulfills two different functions. The neon gas discharge lamp serves both for generating a red brake light as well as for generating an orange blinking light. In order to operate the neon gas discharge lamp, a pulse generator is used, which generates voltage pulses for the electrodes of the discharge lamp. In order to produce the red brake light, the pulse duration and the pulse spacing of the voltage pulses are adjusted in such a way that the neon participating in the gas discharge is essentially stimulated only for yielding red light. For the production of the orange blinking light, the pulse duration and the pulse spacing of the voltage pulses are selected such that the neon that participates in the gas discharge red light that propagates is also stimulated to yield UV radiation, which in turn is converted into green light by the fluorescent layer, so that the neon gas discharge lamp overall emits an orange light in this operating mode. The emitted light or radiation of the neon gas is modified here by a variation of pulse duration and pulse spacing, so that the color location of the emitted light can be adjusted within certain limits.

SUMMARY OF THE INVENTION

It is the object of the invention to provide a process and a circuit arrangement to operate at least one discharge lamp, so that the same discharge lamp can be used in a motor vehicle for two different functions, i.e., on the one hand, for generating a taillight and on the other hand, for also producing a signal light.

The operating process according to the invention for the at least one discharge lamp is characterized by the fact that the at least one discharge lamp is operated for producing the taillight with a first, smaller electrical power, and for the production of the signal light, with a second, higher electrical power. In this way, the brightness of the at least one discharge lamp is correspondingly greater during operation as a signal light than during its operation as a taillight. In order to assure a difference in brightness between the two different modes of operation that is as significant as possible, the second, higher electrical power for signal light operation is advantageously at least double the value of the first electrical power for operating the taillight of the at least one discharge lamp. In the case of the signal light, we are dealing here advantageously with the brake light of the motor vehicle, which has the same light color as the taillight.

The operating method according to the invention can be applied advantageously to fluorescent lamps or to discharge lamps with ionizable filling containing neon or particularly advantageously, to neon gas discharge lamps. All three of these named lamp types offer the advantages of a long service life, a high light yield and a short response time. In addition, the use of fluorescent lamps is advantageous for producing any light colors for the signal lights, which can be adjusted simply by the selection of the fluorescent coating of the discharge vessel. On the other hand, a discharge lamp with an ionizable filling containing neon is advantageous for generating red light, since the neon is stimulated in the gas discharge to yield red light. Particularly advantageous is the use of a neon gas discharge lamp for the operating method according to the invention, especially if a brake light is involved as the signal light, for which a light of red color must be generated, the same as for the taillight, since the ionizable filling of neon gas discharge lamps exclusively comprises neon and thus does not contain substances that are harmful to the environment, such as, for example, mercury, and in addition, fluorescent substances are not required for producing the red light.

The at least one discharge lamp is advantageously supplied with an intermediate-frequency alternating voltage, whose frequency amounts to preferably at least 20 kHz, whereby an operating parameter of the at least one discharge lamp—preferably the lamp current flowing over the discharge segment or the voltage drop over the lamp—is controlled during its operation by means of the method of pulse-width modulation, by conducting a comparison of theoretical and actual values for voltage signals proportional to this operating parameter. This monitoring and control of the operating parameter of the at least one discharge lamp makes it possible to control in a simple way the electrical power of the at least one discharge lamp for both modes of operation at an approximately constant value, i.e., during operation as a taillight at the first, lower value and during operation as a signal light at the second, higher value, by application of the method of pulse-width modulation, and in fact to control it extensively independently of changes or fluctuations in the on-board voltage of the motor vehicle. The pulse duty factor of the signals generated by the pulse-width modulation differ considerably in the two modes of operation of the at least one discharge lamp. Advantageously, the quotient $\tau_2/\tau_1$ of the pulse duty factor $\tau_1$ of the pulse-width modulation signal during lamp operation with the first, lower electrical power and the pulse duty factor $\tau_2$ of the pulse-width modulation signal during lamp operation with the second, higher electrical power lies between 1.2 and 3.

The circuit device according to the invention for carrying out the operating process of the invention advantageously has a voltage transformer preferably designed as a push-pull transformer, which produces the intermediate-frequency supply voltage for the at least one discharge lamp from the on-board voltage of the motor vehicle, and has a control device for the voltage transformer, which carries out the control of pulse-width modulation of the voltage transformer. The comparison of the theoretical value to the actual value for the operating parameter to be monitored and controlled for the at least one discharge lamp can be carried out advantageously in a relatively simple way by means of an operational amplifier and a voltage divider that can be switched between two settings. The alternation between the two modes of operation of the at least one discharge lamp is produced simply by a switching of the voltage divider between its two settings. An electronic switch is advantageously used for switching the voltage divider. The control device of the voltage transformer is advantageously designed as an integrated circuit, which effects the pulse-wideth width modulation control of the voltage transformer and in which the named operational amplifier is also integrated advantageously.

BRIEF DESCRIPTION OF THE DRAWINGS

The invention will be explained below in more detail on the basis of a preferred example of embodiment. Here.

BEST MODE FOR CARRYING OUT THE INVENTION

Figure 1:
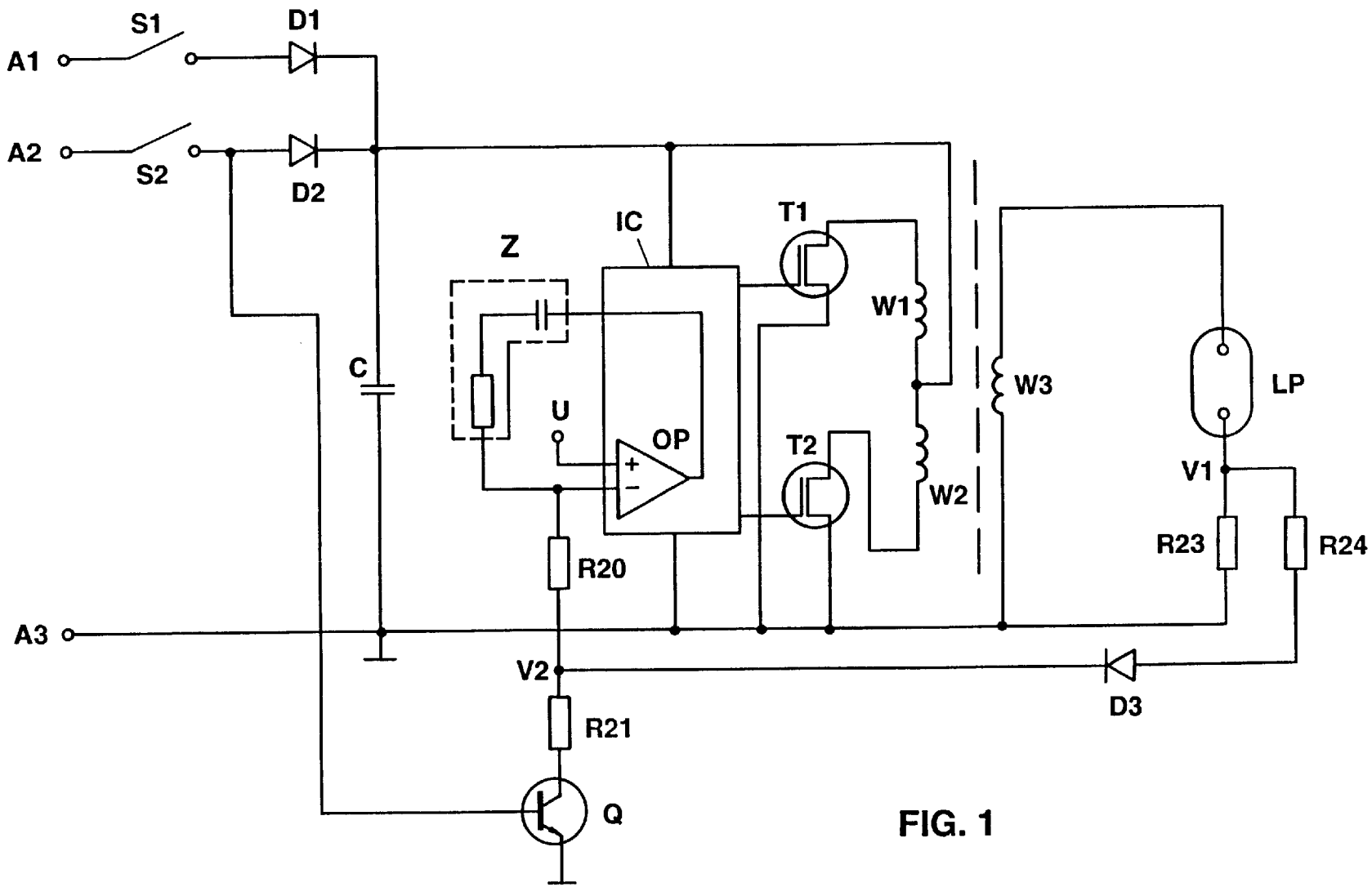
FIG. 1 shows a schematic presentation of the circuit arrangement according to the invention for carrying out the operating method of the invention.

FIG. 1 illustrates the principle of the circuit arrangement according to the invention for operating a neon gas discharge lamp LP arranged at the rear of a motor vehicle. This circuit arrangement has a push-pull transformer, which is constructed in the known way from two switching transistors T1, T2 and a transformer with two primary windings W1, W2 and a secondary winding W3, and a load circuit, in which the neon gas discharge lamp LP, secondary winding W3 of the transformer and a current sensor resistance R23 are connected, as well as a control device IC for switching transistors T1, T2 of the push-pull transformer. The control device is designed as integrated circuit IC, particularly as a pulse-width modulation component IC, which also contains an operational amplifier OP. The circuit arrangement according to the invention also has a resistance R24, a voltage divider R21, R20, a transistor switch Q, a feedback branch Z, a rectifier diode D3, a buffer capacitor C and two Schottky diodes D1, D2. The two Schottky diodes protect the circuit arrangement in case the plus and minus poles are reversed when connecting to the on-board network.

The push-pull transformer is connected during lamp operation via terminal connection A3 with the negative pole of the motor vehicle voltage source and is connected with the positive pole of the motor vehicle voltage source by means of parallelly arranged terminal connections A1 and/or A2, depending on the position of switches S1, S2 assigned to them. It transforms the low-volt d.c. voltage supplied by the motor vehicle voltage source into an intermediate-frequency alternating voltage with a frequency of approximately 35 kHz. This alternating voltage is up-transformed to the voltage values necessary for igniting and operating lamp LP by means of transformer W1, W2, W3. The ignition voltage of the neon gas discharge lamp amounts to approximately 6 kV. The effective values of the operating voltage of the lamp and of the lamp current flowing over the discharge segment amount to approximately 850 V and 17 mA.

In order to operate the neon gas discharge lamp LP in its function as a taillight, switch S1 must be closed, while switch S2 remains open. Then the push-pull transformer and its control device are connected to the low-volt voltage source of the motor vehicle by means of terminal connections A1 and A3, so that switching transistors T1, 2 of the push-pull transformer controlled in an alternating manner by the integrated circuit IC up-transform the low-volt d.c. voltage supplied by the motor vehicle battery by means of transformer W1, W2, W3, into an intermediate-frequency alternating voltage with a frequency of approximately 35 kHz, which is sufficient for igniting and operating the lamp. The control device IC produces pulse-width modulation signals for controlling the gate electrodes of the two switching transistors T1, T2. On the one hand, changes or fluctuations of the battery voltage in the motor vehicle are controlled by means of the pulse-width modulation, and on the other hand, a power control of the neon gas discharge lamp LP is carried out by means of the operational amplifier OP contained in the integrated circuit and by means of resistance R24 as well as by means of feedback branch Z of operational amplifier OP. The electrical power consumption of lamp LP is controlled at a value of approximately 6 W during its operation as a taillight. For this purpose, a voltage signal proportional to the lamp current is produced by means of a branch point V1 in the load circuit by means of resistance R24, it is decoupled from the load circuit and conducted in the forward direction by means of rectifier diode D3, central tap V2 of voltage divider R21, R20 and by means of voltage divider resistance R20 to the inverting input of operational amplifier OP. In addition, the non-inverting input of operational amplifier OP is connected to an auxiliary voltage source U, which supplies a constant reference voltage, and the output of operational amplifier OP is fed back to the inverting input of operational amplifier OP by means of a feedback branch Z. In this way, a control circuit for controlling the lamp current and thus also for controlling the lamp power is formed by operational amplifier OP, feedback branch Z and resistances R20, R24. During the control process, the operational amplifier carries out a comparison of the theoretical and actual values of its input signals. The output signal of the operational amplifier OP influences the pulse duty factor of the pulse width modulation signals generated by the IC-component IC, which serve for control of switching transistors T1, T2 of the push-pull transformer. The pulse duty factor of the pulse-width modulation signals is also dependent on the instantaneous on-board voltage of the motor vehicle. By means of the above-described control circuit, the lamp power can be controlled to an approximately constant value of roughly 6 W, extensively independent of changes in the on-board voltage.

When the brake pedal is activated in the motor vehicle, switch S2 is closed. This has as a consequence the fact that neon gas discharge lamp LP is now operated as a brake light, independently of the position of switch S1. The push-pull transformer T1, T2, W1, W2, W3 and its control device IC are connected to the low-volt voltage source, i.e., to the battery or the generator of the motor vehicle by means of terminal connections A2 and A3, so that switching transistors T1, T2 of the push-pull transformer that are controlled in alternating manner by the integrated circuit IC up-transforms the low-volt d.c. voltage supplied by the motor vehicle battery to an intermediate-frequency alternating voltage with a frequency of approximately 35 kHz, which is sufficient for igniting and operating the lamp, as has already been described further above in the explanation of the taillight function of the neon gas discharge lamp. The control device IC also produces pulse-width modulation signals during the operation of the brake light of the neon gas discharge lamp for controlling the gate electrodes of both switching transistors T1, T2. On the one hand, changes or fluctuations of the battery voltage in the motor vehicle are controlled by means of the pulse-width modulation, and, on the other hand, a power control of the neon gas discharge lamp LP will be carried out via the operational amplifier OP contained in the integrated circuit and by means of resistance R24 as well as by means of feedback branch Z. The electrical power consumption of lamp LP is controlled to a value of approximately 20 W during its operation as a brake light. For this purpose, a voltage signal proportional to the lamp current is produced by means of branching point V1 in the load circuit by means of resistance R24, decoupled from the load circuit, and conducted in the forward direction to the inverting input of operational amplifier OP via the rectifier diode D3, central tap V2 of voltage divider R21, R20 and by means of the voltage divider resistance R20. Of course, a part of the voltage signal decoupled from the load circuit is drawn off to the negative pole of the on-board voltage source of the motor vehicle by means of the voltage divider resistance R21 and the now conducting collector-emitter segment of transistor switch Q, so that the inverting input of operational amplifier OP now receives a reduced signal in comparison to the taillight operation during the brake-light operation of lamp LP, since when switch S2 is closed and switch S1 has any position, the base terminal of transistor switch Q is loaded with a control signal, which has as a consequence a through-connection of the collector-emitter segment of transistor switch Q. Operational amplifier OP, feedback branch Z and resistances R20, R24 also form a control circuit for controlling the lamp current or for controlling the lamp power during operation of the brake light. During the control process, the operational amplifier OP again carries out a theoretical-actual value comparison of its input signals, of course, with an input signal that has been changed relative to the taillight operation at the inverting input of operational amplifier OP. The output signal of operational amplifier OP influences the pulse duty factor of the pulse-width modulation signals generated by the IC component IC, which serve for controlling switching transistors T1, T2 of the push-pull transformer. By means of the above-described control circuit, the lamp power will be regulated to an approximately constant value of roughly 20 W during the operation of the brake light, extensively independently of changes in the on-board voltage. The pulse duty factor of the pulse-width modulation signals is also dependent, however, on the instantaneous on-board voltage of the motor vehicle.

The change from taillight to brake-light operation of neon gas discharge lamp LP is thus carried out as follows: the resistance of voltage divider R21, R20 effective at the inverting input of the operational amplifier is reversed by means of transistor switch Q. During the taillight operation, the voltage divider resistance R21 is ineffective, since the collector-emitter segment of transistor switch Q is high-ohm. During the brake-light operation, the two voltage divider resistances R21, R20 are connected in parallel due to the now conducting collector-emitter segment of transistor switch Q.

Figure 2:
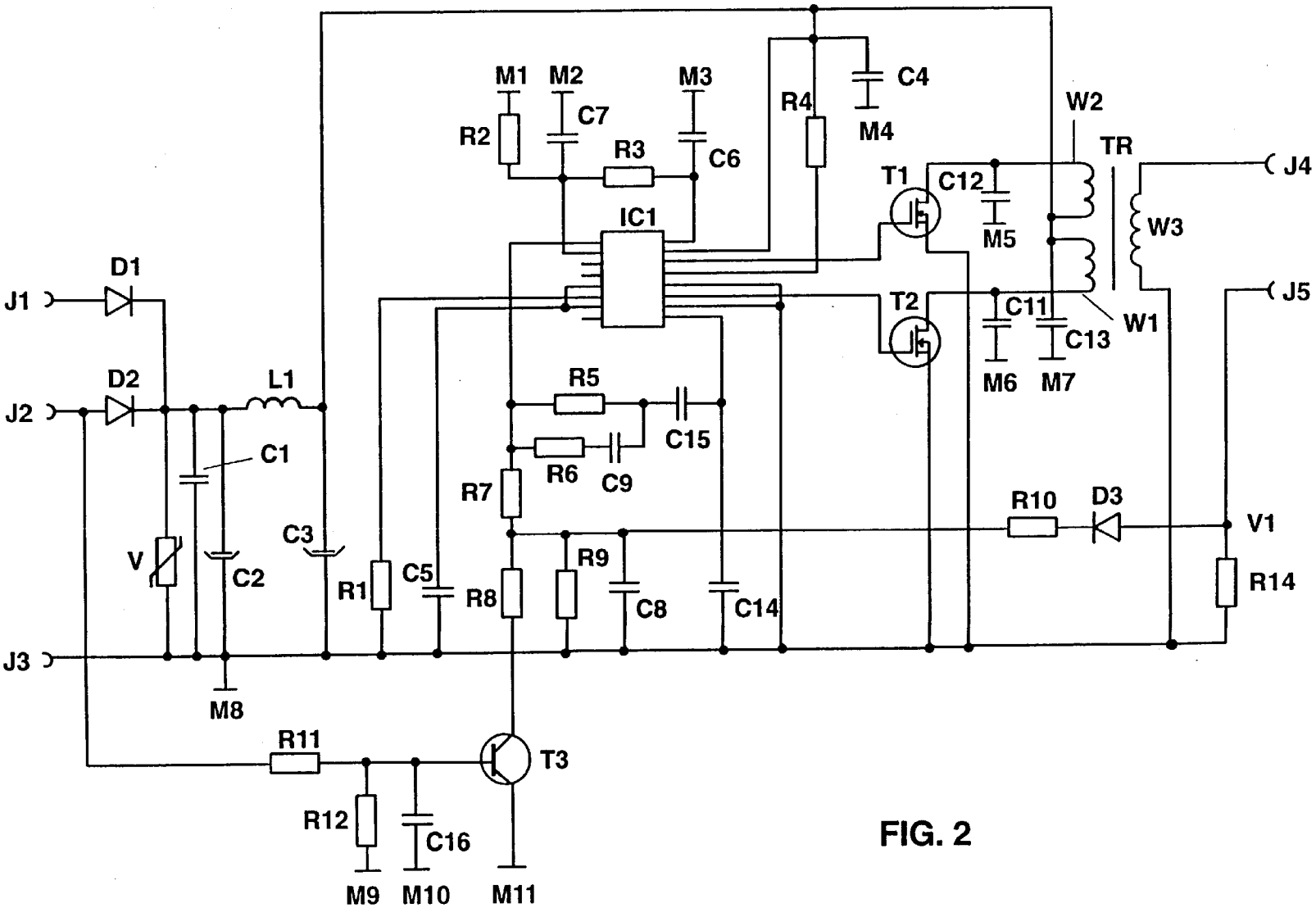
FIG. 2 shows a detailed circuit diagram of the preferred example of embodiment of the circuit arrangement according to the invention from FIG. 1.

FIG. 2 shows the complete circuit diagram of the circuit arrangement according to the preferred example of embodiment. A suitable dimensioning of the components used is given in Table 2. The terminals J1, J2 are connected to the plus pole and the terminal J3 is connected to the minus pole (ground) of the automobile battery. The varistor V serves as protection from overvoltage and the Schottky diodes D1, D2 protect the circuit arrangement in the case when the plus and minus poles are reversed in connecting the circuit arrangement. Inductor L1 and capacitor C1 form an LC low-pass filter. Electrolytic capacitors C2, C3 serve as buffer capacitors for the energy supply of the push-pull transformer and its control device. The push-pull transformer comprises the two field-effect transistors T1, T2, the transformer TR with its two primary windings W1, W2 and its secondary winding W3, as well as the capacitors C11, C12, C13. The secondary winding W3 of transformer TR feeds the load circuit, and the neon gas discharge lamp (not illustrated) is connected to its terminals J4, J5. The control device of the push-pull transformer is comprised of the integrated circuit IC1, which carries out a pulse-width modulation control of the push-pull transformer by means of its outputs connected with the gate electrodes of field-effect transistors T1, T2. Integrated circuit IC1 also contains an operational amplifier; an auxiliary voltage source comprising the components R2, R3, C6 and C7 is connected to the non-inverting input of this amplifier, and this auxiliary voltage source produces a reference voltage of 1.8 V. The branch point VI is connected to the inverting input of the operational amplifier integrated into the integrated circuit IC1 by means of rectifier diode D3 and voltage divider resistances RIO and R7. The resistance R14 connected in the load circuit serves for detecting the lamp current. It produces a voltage drop proportional to the lamp current. The control circuit for controlling the lamp current and the lamp power also contains the voltage divider constructed from resistances R7, R8, R9, R10 and the feedback branch comprising components R5, R6, C9, C15, which feeds back the output of the operational amplifier to its inverting input. The change from taillight to brake-light operation of the lamp is produced by means of the small-signal bipolar transistor T3, whose collector is connected to resistance R8 and whose emitter is connected to ground. The base terminal of bipolar transistor T3 is connected to terminal J2 by means of the base resistance R11. The components R1, C5, R4, C4 serve for voltage supply and for adjusting the clock frequency of the integrated circuit IC1 to approximately 35 kHz. The terminals M1 to M11 all lie at ground potential. The circuit arrangement also has the components R12, C16, C14 and C8 important for the dimensioning.

This circuit arrangement permits controlling changes in the on-board voltage of the motor vehicle in the range of 9V to 18V, so that the lamp can be operated in this range with approximately constant power for both operating modes. Table 1 contains a compilation of the operating data of the different operating conditions for an on-board voltage of 13.5 V. Here, the system yield amounts to 11.7 Im/W. The efficiency of this circuit arrangement is greater than 80%. The quotient of the pulse duty factors of the brake-light and taillight operations amounts to approximately 1.8 according to the values in Table 1.

The invention is not limited to the example of embodiment explained in detail above. The operating process according to the invention can also be applied to several, for example, two simultaneously operating discharge lamps. These simultaneously operating discharge lamps can be operated either with a single operating device or with two separate operating devices with the circuit arrangement according to the invention. The operating process according to the invention is suitable not only for neon gas discharge lamps, but also, for example, for fluorescent lamps. In the circuit arrangement according to the invention, the push-pull transformer may also be replaced by another suitable voltage transformer. Further, instead of the lamp current, the voltage drop over the lamp may also be utilized for controlling the lamp power.

TABLE 1

| | taillight operation | Brake-light operation |
|---|---|---|
| Electrical power consumption of the lamp | 6.2 W | 20.1 W |
| Pulse duty factor | 8.8% | 16% |

TABLE 2

Dimensioning of the components according to the circuit arrangement of the invention illustrated in FIG. 2

| | |
|---|---|
| R1 | 3 kΩ |
| R2 | 5.6 kΩ |
| R3, R11, R12 | 10 kΩ |
| R4 | 10Ω |
| R5 | 68 kΩ |
| R6 | 6.8 kΩ |
| R7 | 1.5 kΩ |
| R8 | 12 kΩ |
| R9 | 100 kΩ |
| R10 | 47 kΩ |
| R14 | 820 kΩ |
| V | S10V-S14K14 |
| L1 | 100 μH |
| TR | 160 μH, 160 μH, 2.3 H |
| T1, T2 | BUZ71 |
| T3 | BC337C |
| D1, D2 | Schottky diodes |
| D3 | 1N4148 |
| C1, C4, C6, C7, C15, C16 | 100 nF |
| C2 | 220 μF, 25 V |
| C3 | 1000 μF 25 V |
| C5 | 4.7 nF |
| C8 | 1 μF |
| C9 | 1 nF |
| C11, C12 | 15 nF |
| C13 | 150 nF |
| C14 | 470 pF |
| IC1 | IC component SG 2525 of SGS Thomson |

What is claimed is:

1. An apparatus for operating at least one discharge lamp from an on-board voltage source of a motor vehicle, whereby the at least one discharge lamp has a gas-tight closed discharge vessel with ionizable filling and electrodes enclosed therein, and between these electrodes gas discharge is formed during operation, is characterized in that the at least one discharge lamp is operated for producing a taillight of the motor vehicle with a first, smaller electrical power and is operated wit a second, higher electrical power for producing a signal light.

2. The apparatus according to claim 1, further characterized in that the second, higher electrical power is at least double the first, smaller electrical power.

3. The apparatus according to claim 1, further characterized in that the signal light is a brake light.

4. The apparatus according to claim 1, further characterized in that the ionizable filling of the at least one discharge lamp contains neon.

5. The apparatus according to claim 4, further characterized in that the discharge lamp is a neon gas discharge lamp.

6. The apparatus according to claim 1, further characterized in that the at least one discharge lamp is a fluorescent lamp.

7. The apparatus according to claim 1, further characterized in that the at least one discharge lamp is supplied with an intermediate-frequency supply voltage, whereby an operating parameter of the at least one discharge lamp is controlled during-operation by means of a pulse-width modulation signal, in that a theoretical-actual value comparison is conducted for a voltage signal proportional to the operating parameter.

8. The apparatus according to claim 7, further characterized in that the operating parameter of the lamp is controlled at a first, essentially constant value during operation of the lamp with the first, smaller electrical power, and is controlled at a second, essentially constant value during operation of the lamp with the second, higher electrical power.

9. The apparatus according to claim 7, further characterized in that the operating parameter is lamp current.

10. The apparatus according to claim 7, further characterized in that the operating parameter is voltage drop across the lamp.

11. The apparatus according to claim 8, further characterized in that a quotient $\tau_2/\tau_1$ of a pulse duty factor $\tau_2$ of the pulse-width modulation signal during lamp operation with the second, higher electrical power and of pulse duty factor $\tau_1$ of the pulse-width modulation signal during lamp operation with the first, lower electrical power lies between 1.2 and 3.

12. The apparatus according to claim 7, further characterized in that the intermediate-frequency supply voltage has a frequency of at least 20 kHz.

13. The apparatus according to claim 3, further characterized in that two electrical lamps are operated simultaneously for producing the taillight of the motor vehicle with a first electrical power and for producing the brake light with a second, higher electrical power.

14. A circuit arrangement for operating at least one discharge lamp from an on-board voltage source of a motor vehicle, the circuit arrangement comprising means for operating the at least one discharge lamp at a first, smaller electric power for producting a tallight of the motor vehicle and at a second, higher electrical power for producing a signal light.

15. The circuit arrangement according to claim 14, further characterized in that the at least one discharge lamp is supplied with an intermediate-frequency supply voltage, whereby an operating parameter of the at least one discharge lamp is controlled during operation by means of pulse-width modulation, in that a theoretical-actual value comparison is conducted for a voltage signal proportional to the operating parameter, the intermediate-frequency supply voltage for the at least one discharge lamp (LP) is generated from the on-board supply voltage of the motor vehicle by means of a voltage transformer (T1, T2) and the circuit arrangement has a control device (IC), which conducts a pulse-wideth modulation control of the voltage transformer (T1, T2).

16. The circuit arrangement according to claim 15, further characterized in that the voltage transformer is a push-pull transformer.

17. The circuit arrangement according to claim 15, further characterized in that the theoretical-actual value comparison is carried out by means of an operational amplifier (OP) and a voltage divider (R21, R20) that can be switched between two settings, and the change between modes of operation with low and high electrical power for the at least one discharge lamp is produced by switching the voltage divider (R21, R20) between the two settings.

18. The circuit arrangement according to claim 17, further characterized in that the switching of the voltage divider (R21, R20) is carried out by means of an electronic switch (Q).

19. The circuit arrangement according to claim 15, further characterized in that the control device contains an integrated circuit (IC), which carries out the pulse-width modulation control of the voltage transformer (T1, T2).

20. The circuit arrangement according to claim 19, further characterized in that the operational amplifier (OP) is a component of the integrated circuit (IC).

21. The circuit arrangement according to claim 15, further characterized in that:

the voltage transformer (T1, T2) is equipped with a transformer (W1, W2, W3) and with at least one switching transistor, which is connected to the on-board voltage source of the motor vehicle and which loads a load circuit, in which the at least one discharge lamp (LP) is connected, with an alternating voltage, an integrated circuit (IC) controls the at least one switching transistor of the voltage transformer (T1, T2), whereby the integrated circuit (IC) is a pulse-width modulation unit, which is connected with a control electrode of the at least one switching transistor (T1, T2) and contains an operational amplifier (OP) with two signal inputs (+, −) and one signal output, a voltage divider (R21, R20) is included with several terminals, whereby a first terminal of the voltage divider (R21, R20) is connected in the load circuit by means of a rectifier (D3) with a branch point (V1), and a second terminal of the voltage divider (R21, R20) is connected to the first signal input (−) of the operational amplifier (OP), and a third terminal of the voltage divider (R21, R20) is connected with a switching segment of an electronic switch (T3), the second signal input (+) of the operational amplifier (OP) is connected to an auxiliary voltage source (U), which produces a constant reference voltage, and the first signal input (−) of the operational amplifier (OP) is fed back to the signal output.

* * * * *